US005575080A

United States Patent [19]

Fleissner

[11] Patent Number: 5,575,080

[45] Date of Patent: Nov. 19, 1996

[54] DEVICE FOR THE CONTINUOUS-FLOW TREATMENT OF TEXTILE MATERIAL OR LIKE FIBER CONTAING MATERIAL

[75] Inventor: Gerold Fleissner, Zug, Switzerland

[73] Assignee: Fleissner GmbH & Co., KG, Egelsbach, Germany

[21] Appl. No.: 552,124

[22] Filed: Nov. 2, 1995

Related U.S. Application Data

[63] Continuation-in-part of Ser. No. 493,321, Jun. 21, 1995.

[30] Foreign Application Priority Data

Jun. 28, 1994 [DE] Germany ..... 44 22 508.3

[51] Int. Cl.[6] ..... D06B 5/08

[52] U.S. Cl. ..... 34/122; 68/5 D; 68/903

[58] Field of Search ..... 68/903, 5 D, 5 E, 68/158, 184; 34/115, 122

[56] References Cited

U.S. PATENT DOCUMENTS 2,054,391 9/1936 Schmidt ..... 34/115

3,510,959 5/1970 Fleissner ..... 34/115

FOREIGN PATENT DOCUMENTS 834638 5/1960 United Kingdom ..... 34/115

*Primary Examiner*—Philip R. Coe

*Attorney, Agent, or Firm*—Antonelli, Terry, Stout & Kraus

[57] ABSTRACT

A permeable sheet-metal drum for the wet or dry treatment of textile material, paper or other permeable material of a certain width comprises a normal perforated sheet-metal drum body, on which, along the length of the drum body, projecting sheet-metal strips are attached at a distance from one another. The attachment is achieved by means of bolts or rivets which are inserted into a transverse flange of each metal strip which is perforated like the perforations of the drum and extends perpendicular to each of the sheet-metal strips. The sheet-metal strips increase the drum's resistance to denting and improve the uniform ventilation of the textile or like material lying externally on the edges of the sheet-metal strips on a screen mesh covering.

16 Claims, 2 Drawing Sheets

DEVICE FOR THE CONTINUOUS-FLOW TREATMENT OF TEXTILE MATERIAL OR LIKE FIBER CONTAING MATERIAL

CROSS-REFERENCE TO RELATED APPLICATION

This application is a continuation-in-part of application Ser. No. 08/493,321, filed on Jun. 21, 1995.

BACKGROUND OF THE INVENTION

This invention relates to an improved device for the continuous-flow treatment of textile material, fleeces or paper with a gaseous or liquid treatment medium circulated in the device having a permeable sheet-metal drum as a transport member, said drum being under suction and having bases on its ends, and its perimeter or peripheral surface covered with a screen-type layer, and between the screen-type layer and the perimeter of the drum, as a support or girder means to increase the distance between the drum body and the screen-type layer, there are disposed parallel over the whole length of the drum from base to base straight sheet-metal strips, the sheet-metal drum fitting directly against the radially inwardly-situated edges of the metal strips, and these metal strips being closely connected with the outer perimeter of the sheet-metal drum body. A device having such an arrangement is disclosed in German application P 44 22 508.3 and corresponding U.S. application Ser. No. 08/493,321.

The particular advantages of a screen drum construction in which a girder construction known from DE 38 05 738 A1, in a drum sheet-metal casing construction, is replaced by upright sheet-metal strips which extend parallel over the whole length of the drum unbent from one end of the drum to the other, is an inexpensive drum construction with extremely high air permeability in the region of the textile material lying on it, although the sheet-metal drum support structure which is not so permeable and it in itself an obstacle, remains unchanged. These metal strips serve only to increase the distance of the screen cloth from the sheet-metal casing and increase the distance between the screen drum and the screen cloth in such a way, that the lesser air permeability of the perforated drum is not a significant factor. In this construction the increase in resistance of the screen drum to denting is also important.

Sheet-metal strips extending in a two-dimensional plane can only be attached to the screen drum by welding. But not only does the welding process result in structural changes in the metal, but the welding seams can also in the long run tear under extreme thermal stress, for instance, through constant temperature changes to the screen drum as when cold and wet material come in as opposed to the dry and hot material which has just left. Expensive repairs are then necessary.

SUMMARY OF THE INVENTION

An object underlying the present invention is to further develop a screen drum device with a basic construction similar to the prior application, Ser. No. 08/493,321 in such a way that the air permeability remains constant over the whole surface of the material and yet the problems heretofore mentioned no longer exist.

This object is fulfilled according to the invention by providing the radially inwardly-situated edges of the metal strips with a flange and it is this flange that is tightly connected to the outer peripheral surface of the drum. In this way it is possible to attach the sheet-metal strips to the drum with rivets or bolts and to avoid use of welds.

It is particularly advantageous if at the free end of the flange a further sheet-metal strip is attached at right angles to provide a double sheet-metal strip bent in a U-shape. The flange or the base of this double sheet-metal strip should be perforated in the same way as the screen drum body, so that not only can the holes or the perforations be used for fastening but also so that the air permeability of the drum is not, or only slightly, reduced by the area of the flange or the base of the U-shaped double sheet-metal strip. Since, however, some or other of the holes or the perforations are closed by the nuts or bolts used in fastening, the invention provides, as a more advantageous arrangement, for the metal strips projecting radially upright also to be perforated. In this way the air permeability of the areas with the perforation or holes that are closed by bolts is adjusted to that of the areas lying between the fastening flanges..

BRIEF DESCRIPTION OF THE DRAWINGS

The accompanying drawings show embodiments, given by way of example, of the device according to the invention, wherein.

DETAILED DESCRIPTION OF THE INVENTION

Figure 1:
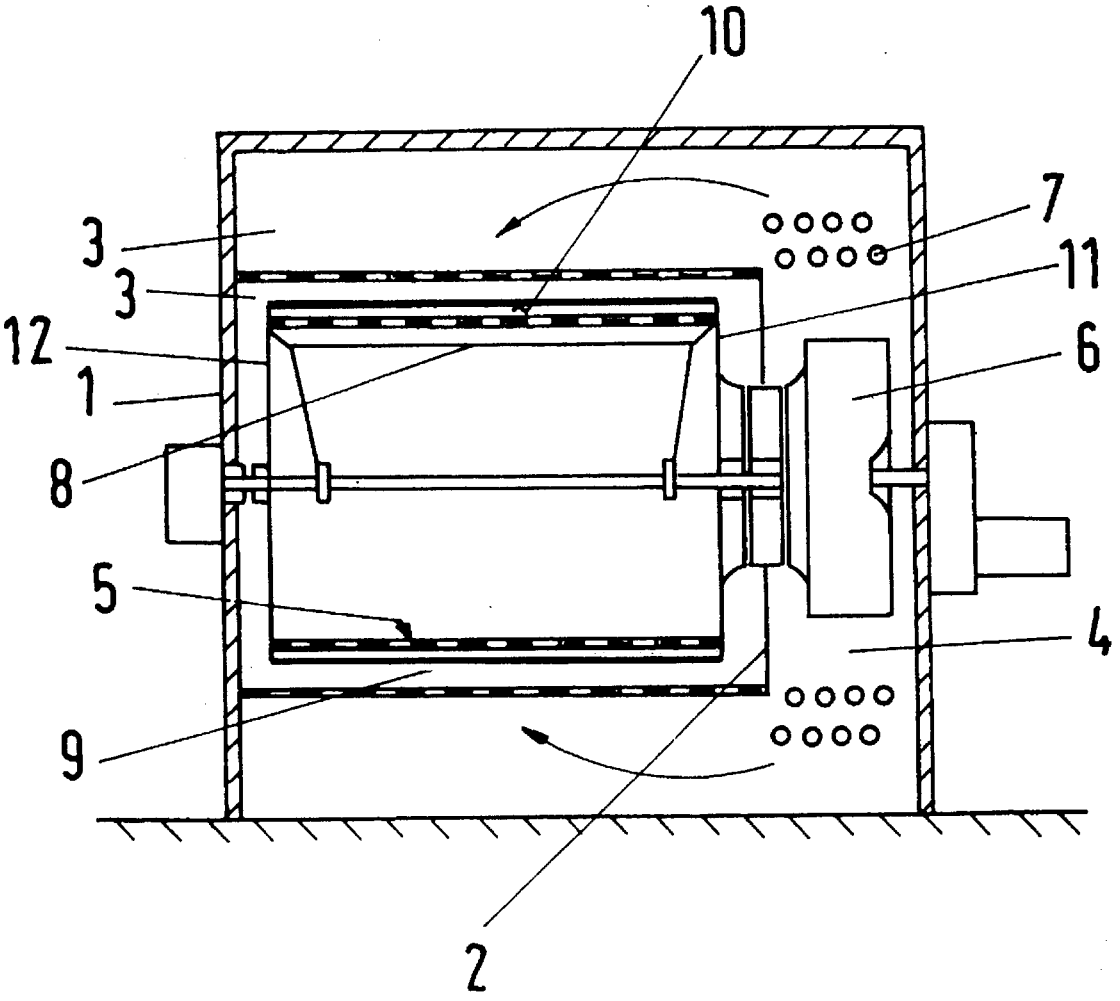
FIG. 1 is a longitudinal section of a screen drum device, the casing of which consists here of a perforated metal drum with sheet-metal strips standing vertically upright on the drum and a screen cloth being positioned radially outside the metal drum.

The screen drum device of the invention is comprised basically of a substantially rectangular housing 1 which is divided by a partition wall 2 into a treatment area 3 and a blower area 4. In the treatment area 3 the screen drum is mounted rotationally and a blower or fan 6 is mounted concentrically to it in the blower area 4. The blower area can, of course, be disposed in a special blower casing, separate from the screen drum housing 1, and not shown here. In any case the blower places the inside of the drum under suction. The drum construction in a wet treatment device, which can also serve just to draw off a liquid is also the subject-matter of the invention. The total construction has then to be adapted accordingly.

According to FIG. 1, above and below the blower 6 are disposed heating units which comprise pipes through which a heating medium flows. In an area, which is not covered by the textile material, the screen drum is shielded internally from the gas suction by an inner cover 8. The effective conveying or transporting section of the screen drum is formed by the perforated metal sheet of the drum described below together with a grid or support structure of sheet-metal strips according to FIGS. 2–4. This structure is surrounded externally by a fine-meshed screen 9 which on the end face of the drum is held taut onto the two bases (11, 12) by means of rings (not shown).

Figure 2:
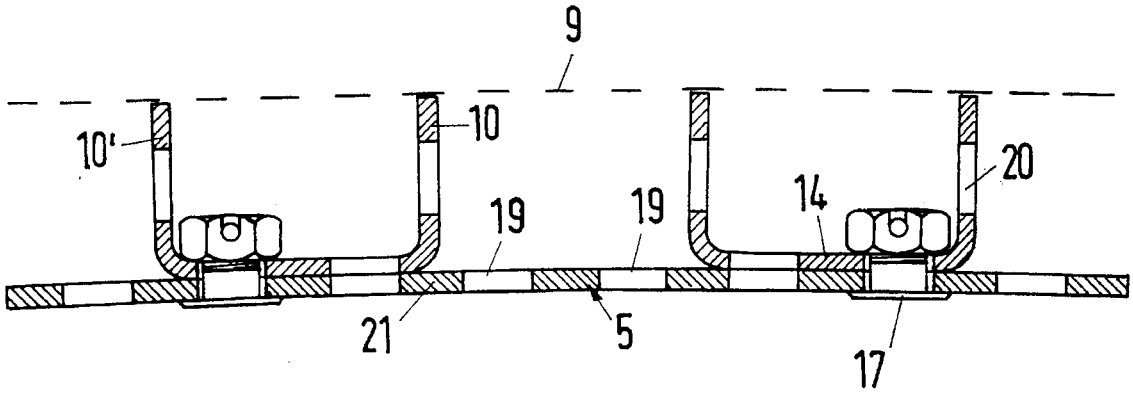
FIG. 2 is an enlarged partial section of a detail of the sheet-metal support arrangement of the screen drum device with the section being transverse to that shown in FIG. 1.
Figure 3:
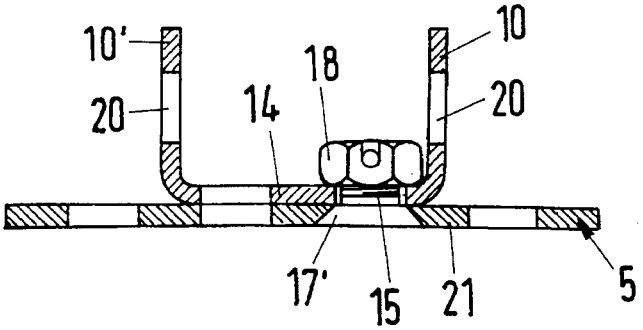
FIG. 3 is an enlarged partial section of another detail of the sheet-metal support structure of the screen drum device.
Figure 4:
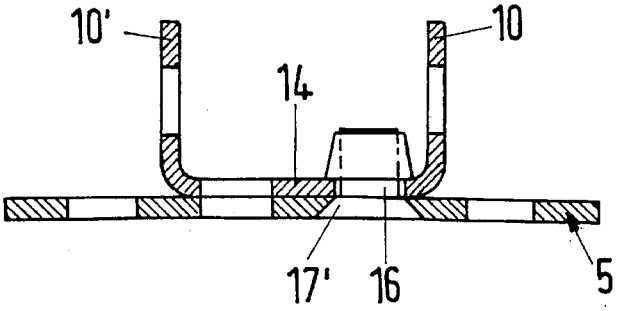
FIG. 4 is an enlarged partial section of a further detail of the support structure of the screen drum device.

The sheet-metal strip structure comprises axially extended metal strips, the radially aligned height of which is evident from FIGS. 2–4. Thus, the fine-meshed screen or covering 9 is only lying on the radially externally-situated edges of the metal strips. The metal strips 10 lie with their radially inwardly-situated edges directly on the periphery of the drum body 5 and are disposed substantially parallel at a defined distance beside one another on the curved surface of the drum body 5.

So that this distance and the exact alignment of the metal strips 10 is fixed over the working width of the drum, the radially inwardly-situated edges of the metal strips 10 are, contrary to the disclosure of the prior application, provided with a flange 14 which projects at a right angle from a metal strip 10, and is bolted onto the screen drum 5 through one of its perforations or connected with a rivet 16. The head 17 of the bolt can lie on the inner side of the drum 5 or, better, be inserted by attachment to the mounting hole as shown in 17'. In any case, the nut 18 of the bolt is disposed on the outside of the flange 14 or of the drum body 5. The flange 14 is provided with perforations, like the screen drum body; the perforations of each align exactly.

It is particularly advantageous when at the free end of the flange 14, an additional metal strip 10 is provided at a right angle to form a double sheet-metal strip bent in a U-shape (10, 14, 10'). This double sheet-metal strip (10, 14, 10'), according to the example, then covers two rows of the perforation holes 19 of the drum body and a further two rows of perforation holes 19 then remain free. The holes used for fastening should be staggered, some in the one row, some in the other as shown in FIG. 2.

So that the holes used for fastening and therefore closed to the passage of air (or other treatment fluid) do not have a disadvantageous effect on the uniform air permeability of the drum over its whole extent, the walls of the strips standing radially upright and therefore the sheet-metal strips (10, 10') themselves are also provided with holes or perforations.

The width of the flange 14 or of the base of the double sheet-metal strip 10, 10' should be chosen so that the sheet-metal strip 10 or, on a double sheet-metal strip, both strip portions (10, 10') of the U-shaped cross-section extend radially over an unperforated cross-piece 21 of the drum periphery. Thus, the material of the double sheet-metal strip (10, 10') does not impede the air permeability of the drum.

What is claimed is:

1. A device for the continuous-flow treatment of textile material, fleece or paper with a gaseous or liquid treatment medium that is circulated in the device having a permeable sheet-metal drum as transport member, said drum being under suction and having bases on its ends, and an outer peripheral surface of the drum being surrounded with a screen mesh covering and between the screen mesh covering and the drum, as a support means to increase the distance between the drum and the screen mesh covering, there are disposed parallel over the whole length of the drum from base to base straight sheet-metal strips, the outer peripheral surface of the sheet-metal drum contacting directly against radially inwardly-situated edges of the metal strips, and the metal strips being closely connected to the outer peripheral surface of the sheet-metal drum; the radially inwardly-situated edges of the sheet-metal strips being provided with a flange that is tightly connected to the outer peripheral surface of the drum and said drum having a plurality of perforations arranged between adjacent strips.

2. A device according to claim 1, wherein the flange projects at a right-angle from each of the metal strips.

3. A device according to claim 2, wherein at the free end of the flange, a further sheet-metal strip is provided at a right-angle to form a double sheet-metal strip bent into a U-shape so that pairs of adjacent metal strips are provided extending over the whole length of the drum.

4. A device according to claim 3, wherein the flange provides a base of the double sheet-metal strip and is secured together by at least one bolt with the perforated outer peripheral surface of the drum.

5. A device according to claim 4, wherein a usual perforation provided for the air permeability of the drum is used for the attachment of the flange base of the double sheet-metal strip to the drum.

6. A device according to claim 5, wherein a head of the at least one bolt lies radially inward on a metal sheet forming the peripheral outer surface of the drum.

7. A device according to claim 5, wherein the head of the bolt is sunk in a respective hole of the sheet metal of the drum.

8. A device according to claim 4, wherein a head of the at least one bolt lies radially inward on a metal sheet forming the peripheral outer surface of the drum.

9. A device according to claim 3, wherein a base of the double sheet-metal strip is riveted on to the perforated outer peripheral surface of the drum.

10. A device according to claim 4, wherein a usual perforation provided for the air permeability of the drum is used for the attachment of the flange base of the double sheet-metal strip to the drum.

11. A device according to claim 3, wherein the double sheet-metal strip and both side strips of the U-shaped cross-section extend radially over a cross-piece of the sheet-metal drum that is not perforated.

12. A device according to claim 1, wherein the flange of the sheet-metal strip is provided with holes over its entire surface, corresponding with the perforations in the permeable sheet-metal drum.

13. A device according to claim 1, wherein radially upright positioned portions of the sheet-metal strips are also perforated.

14. A device according to claim 1, wherein the sheet-metal strip extends radially over a cross-piece of the sheet-metal drum that is not perforated.

15. A device according to claim 1, wherein the flange is connected to the drum by a fastener extending through said flange.

16. A device according to claim 1, wherein the screen mesh covering is a cylindrical structure which extends over the entire length of the drum.

* * * * *